US010395909B2

(12) United States Patent
Yamaguchi

(10) Patent No.: US 10,395,909 B2
(45) Date of Patent: Aug. 27, 2019

(54) MASS SPECTROMETER

(71) Applicant: SHIMADZU CORPORATION, Kyoto-shi, Kyoto (JP)

(72) Inventor: Shinichi Yamaguchi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 244 days.

(21) Appl. No.: 15/108,714

(22) PCT Filed: Jan. 16, 2014

(86) PCT No.: PCT/JP2014/050629
§ 371 (c)(1),
(2) Date: Jun. 28, 2016

(87) PCT Pub. No.: WO2015/107642
PCT Pub. Date: Jul. 23, 2015

(65) Prior Publication Data

US 2016/0329197 A1 Nov. 10, 2016

(51) Int. Cl.
*H01J 49/40* (2006.01)
*H01J 49/42* (2006.01)
*H01J 49/00* (2006.01)

(52) U.S. Cl.
CPC ..... *H01J 49/005* (2013.01); *H01J 49/004* (2013.01); *H01J 49/0031* (2013.01); (Continued)

(58) Field of Classification Search
None
See application file for complete search history.

(56) References Cited

U.S. PATENT DOCUMENTS 5,367,162 A * 11/1994 Holland ..... H01J 49/025 250/283
7,579,585 B2 * 8/2009 Hager ..... H01J 49/0031 250/282

(Continued)

FOREIGN PATENT DOCUMENTS

JP 2012-122871 A 6/2012
WO 2013/171554 A1 11/2013
WO WO 2013171554 A1 * 11/2013 ..... H01J 49/0031

OTHER PUBLICATIONS

International Search Report for PCT/JP2012/070865 dated Feb. 25, 2014 [PCT/ISA/210].

(Continued)

*Primary Examiner* — Gregory J Toatley, Jr.
*Assistant Examiner* — Brandon J Becker
(74) *Attorney, Agent, or Firm* — Sughrue Mion, PLLC

(57) ABSTRACT

The objective of the present invention is to obtain an $MS^2$ spectrum for each of a plurality of different ion species even when their m/z values are extremely close to each other and prevent separate setting of each ion species as the precursor ion. In the vicinity of the target m/z, a precursor-ion selection window covering a predetermined m/z range ($2\times\Delta M$) is gradually shifted in predetermined steps ($\Delta m$) to define a plurality of windows as the condition of the precursor-ion selection. When an $MS^2$ analysis is performed on the same sample for each window, the intensities of the product-ion peaks which appear on the $MS^2$ spectrum change with the change in the central m/z value of the window. From this intensity change, which of the plurality of ion species selected as the precursor ion is the origin of each product ion is determined. Based on the result of this determination, the product ions are sorted out and an $MS^2$ spectrum is reconstructed for each ion species.

2 Claims, 3 Drawing Sheets

(52) U.S. Cl.
CPC ..... *H01J 49/0036* (2013.01); *H01J 49/40* (2013.01); *H01J 49/427* (2013.01)

(56) References Cited

U.S. PATENT DOCUMENTS

2004/0026613 A1* 2/2004 Bateman ..... H01J 49/004 250/281
2005/0206363 A1* 9/2005 Ho ..... H01J 49/0036 324/76.22
2008/0311671 A1* 12/2008 Jiang ..... G01N 33/82 436/96
2009/0121126 A1* 5/2009 Collings ..... H01J 49/0045 250/282
2010/0108879 A1* 5/2010 Bateman ..... G01N 27/622 250/283
2010/0237236 A1* 9/2010 Thomson ..... H01J 49/0045 250/283
2010/0237237 A1* 9/2010 Green ..... H01J 49/004 250/283
2011/0095176 A1* 4/2011 Castro-Perez ..... H01J 49/0031 250/282
2011/0168883 A1* 7/2011 Furuhashi ..... H01J 49/0059 250/288
2011/0297823 A1* 12/2011 Coon ..... H01J 49/0027 250/282
2012/0261564 A1* 10/2012 Belov ..... H01J 49/0031 250/282
2013/0084645 A1* 4/2013 Coon ..... G01N 33/483 436/173
2013/0206979 A1* 8/2013 Bonner ..... H01J 49/0031 250/282

OTHER PUBLICATIONS

Communication dated Dec. 8, 2016, from the European Patent Office in counterpart European application No. 14879054.6.
Written Opinion for PCT/JP2014/050629 dated Feb. 25, 2014. [PCT/ISA/237].
International Search Report for PCT/JP2014/050629 dated Feb. 25, 2014 [PCT/ISA/210].
Communication dated Sep. 3, 2018 from the State intellectual Property Office of the P.R.C. in counterpart Chinese application No. 201480073115.1.
Gillet, L., et al., "Targeted Data Extraction of the MS/MS Spectra Generated by Data-independent Acquisition: A New Concept for Consistent and Accurate Proteome Analysis", Molecular & Cellular Proteomics, vol. 11, No. 6, 2012, 18 pages.

* cited by examiner

MASS SPECTROMETER

TECHNICAL FIELD

The present invention relates to a mass spectrometer, and more specifically, to an $MS^n$ or tandem mass spectrometer capable of fragmenting an ion and performing a mass spectrometry for the ions generated by the fragmentation.

BACKGROUND ART

As one technique of the mass spectrometry, a technique called the "tandem analysis" or "$MS^n$ analysis" is commonly known. The tandem analysis is an analytical technique including the following steps: an ion having a specific mass-to-charge ratio as the target is initially selected from various ions generated from the compounds in a sample; the selected ion (which is normally called the "precursor ion") is fragmented by a collision-induced dissociation (CID) or similar dissociating operation; and a mass spectrometry for the ions generated by the fragmentation (which are normally called the "product ions") is performed. In recent years, this technique has been widely used, mainly for the identification and structural analysis of substances having high molecular weights. For some compounds that cannot be broken into sufficiently small fragments by a single dissociating operation, the selection of the precursor ion and the dissociating operation for that precursor ion may be repeated a plurality of times.

Examples of the commonly known mass spectrometers for tandem analysis include a triple quadrupole mass spectrometer having two quadrupole mass filters placed on the front and rear sides of a collision cell (which is also called the "tandem quadrupole mass spectrometer") as well as a Q-TOF mass spectrometer using a time-of-flight mass analyzer in place of the rear quadrupole mass filter in the triple quadrupole mass spectrometer. These types of mass spectrometers can perform the selection and dissociation of the precursor ion only one time, and therefore, only a tandem analysis of up to $MS^2$ (=MS/MS) analysis can be performed. By comparison, in the case of an ion trap mass spectrometer including an ion trap which is capable of repeatedly performing the selection and dissociation of the precursor ion a plurality of times, or an ion-trap time-of-flight mass spectrometer including an ion trap combined with a time-of-flight mass spectrometer, it is in principle possible to perform an $MS^n$ analysis with no limitation of the value of n.

The process of identifying a compound in a sample using such a tandem analysis is normally performed as follows: An ion having a specific mass-to-charge ratio originating from the compound is fragmented, and a mass spectrometry for the product ions generated by the fragmentation is performed to obtain an $MS^2$ spectrum. The peak pattern of this measured $MS^2$ spectrum is compared with those of the $MS^2$ spectra of known compounds stored in a compound database, and the degree of similarity of the pattern is calculated. With reference to this degree of similarity, the kind of compound is determined. For an exact identification of the compound, it is essential that the peak information observed in the mass spectrum (primarily, the mass-to-charge-ratio values) be highly accurate. In recent years, the performance of mass spectrometers has noticeably improved, and a peak which is merely observed as a single peak on a mass spectrum obtained with a conventional device can often be resolved into a plurality of peaks with a device having a high mass-resolving power. With such an improvement in the mass-resolving power and mass accuracy, the reliability of the compound identification by the previously described database search has also dramatically improved.

While the mass-resolving power of the device has improved in the previously described manner, it is difficult to extremely decrease the mass-to-charge-ratio width which is set for selecting the precursor ion. The reason for this is because the characteristics of the mass-to-charge-ratio window for extracting an ion having a specific mass-to-charge ratio show a comparatively gradual change at both end portions of the window, which means that narrowing the mass-to-charge-ratio selection width decreases the amount of product ions to be subjected to the dissociating operation, making it difficult to detect the product ions with a sufficiently high level of sensitivity (for example, see Patent Literature 1). For such reasons, in commonly used mass spectrometers, the mass-to-charge-ratio selection width for the precursor ion is set at approximately 0.5-2 Da. Therefore, if there are a plurality of kinds of ions with a small difference in mass-to-charge ratio (e.g. 0.5 Da or smaller), a plurality of peaks of the product ions created by the dissociation of a plurality of different ion species will be mixed on the eventually obtained $MS^2$ spectrum. If the peak information derived from such an $MS^2$ spectrum is simply used in the database search, it will be difficult to identify the compound with a sufficiently high level of accuracy.

CITATION LIST

Patent Literature

Patent Literature 1: JP 2012-122871 A

SUMMARY OF INVENTION

Technical Problem

As just described, conventionally, even when it is previously known that there are a plurality of peaks originating from different kinds of ion species within a narrow mass-to-charge-ratio range on a mass spectrum ($MS^1$ spectrum), it is often inevitable to perform the dissociating operation for the entire group of the peaks, so that only an $MS^2$ spectrum in which the product ions generated from the different ion species are mixed can be obtained. On such an $MS^2$ spectrum, it is difficult to discriminate between the product-ion peaks originating from the different ion species. Therefore, it has been difficult to improve the accuracy of the identification of the compound by database search.

Such a problem typically occurs in $MS^2$ spectra, although a similar situation can occur with any $MS^n$ spectra with n being equal to or greater than three.

The present invention has been developed to solve the previously described problem. Its objective is to provide a mass spectrometer capable of discriminating between product ions originating from different precursor ions on an $MS^n$ spectrum (with n being equal to or greater than two) in which the peaks of the product ions obtained by dissociating a plurality of different ion species are mixed, to create an $MS^n$ spectrum which is more suitable for identifying the target compound.

Solution to Problem

The first aspect of the present invention developed for solving the previously described problem is a mass spectrometer for performing an $MS^n$ analysis (where n is any integer equal to or greater than two) by selecting an ion through a window having a predetermined mass-to-charge-ratio width from among the ions originating from a sample, dissociating the selected ion as a precursor ion, and performing a mass spectrometry for the product ions generated by the dissociation, the mass spectrometer including:

a) a measurement executer for changing the central mass-to-charge ratio of the window and for performing an $MS^n$ analysis for the same sample for each change in the central mass-to-charge ratio;

b) a product ion assignment determination processor for comparing a difference in signal intensity of the product-ion peaks appearing at the same mass-to-charge ratio on a plurality of $MS^n$ spectra obtained by the measurement executer, the $MS^n$ spectra respectively corresponding to a plurality of windows having respectively different values of central mass-to-charge ratio, and for determining, based on the result of the comparison, the assignment of each product ion by ascertaining which of a plurality of ion species that are possibly present within the plurality of windows having respectively different values of central mass-to-charge ratio is the origin of that product ion; and c) a spectrum reconstructor for reconstructing the $MS^n$ spectrum for one ion species based on the result of the assignment of the product ions by the product ion assignment determination processor.

The second aspect of the present invention developed for solving the previously described problem is a mass spectrometer for performing an $MS^n$ analysis (where n is any integer equal to or greater than two) by selecting an ion included within a predetermined mass-to-charge-ratio width from among the ions originating from a sample, dissociating the selected ion as a precursor ion, and performing a mass spectrometry for the product ions generated by the dissociation, the dissociation of the ion performed by temporarily capturing an ion to be dissociated in an ion trap and then inducing resonant excitation of the captured ion by the effect of a radio-frequency electric field to make the ion collide with gas, the mass spectrometer including:

a) a measurement executer for changing the central frequency of a radio-frequency voltage applied to the ion trap for the resonant excitation, and for performing an $MS^n$ analysis for the same sample for each change in the central frequency;

b) a product ion assignment determination processor for comparing a difference in signal intensity of the product-ion peaks appearing at the same mass-to-charge ratio on a plurality of $MS^n$ spectra obtained by the measurement executer, the plurality of $MS^n$ spectra respectively corresponding to different values of the central frequency, and for determining, based on the result of the comparison, the assignment of each product ion by ascertaining which of a plurality of ion species that are possibly present within the predetermined mass-to-charge-ratio width is the origin of that product ion; and c) a spectrum reconstructor for reconstructing the $MS^n$ spectrum for one ion species based on the result of the assignment of the product ions by the product ion assignment determination processor.

The mass spectrometer according to the first aspect of the present invention may be any device capable of an $MS^n$ analysis. Examples include the triple quadrupole mass spectrometer, Q-TOF mass spectrometer, ion trap mass spectrometer (IT-MS) and ion-trap time-of-flight mass spectrometer (IT-TOFMS), all of which have already been mentioned, as well as a TOF-TOF system and Fourier transform ion cyclotron resonance mass spectrometer (FT-ICRMS). On the other hand, the mass spectrometer according to the second aspect of the present invention is a mass spectrometer having an ion dissociation unit for selectively inducing resonant excitation of the ions included within a specific range of mass-to-charge ratios to dissociate those ions, such as an IT-MS or IT-TOFMS which is provided with an effective ion trap.

In the mass spectrometer according to the first aspect of the present invention, the measurement executer changes, in steps of a predetermined width, the central mass-to-charge ratio of the window for selecting an ion to be dissociated, and performs an $MS^n$ analysis (e.g. an $MS^2$ analysis) for the same sample for each change in the central mass-to-charge ratio. The step width for shifting the central mass-to-charge ratio may be fixed as a default value, or it may be appropriately set by users. Similarly, the range over which the central mass-to-charge ratio of the window can be changed (mass-to-charge-ratio range) may be automatically set based on some specific kind of information, such as the target mass-to-charge ratio or the distribution of the peaks located near the target mass-to-charge ratio on an $MS^{n-1}$ spectrum (typically, an $MS^1$ spectrum), or it may be appropriately set by users.

For example, consider the case where ions that have originated from two mutually different kinds of compounds with close mass-to-charge ratios (e.g. with a difference of 0.5 Da or smaller) are contained in a sample. When an $MS^n$ analysis is performed a plurality of times while gradually shifting the central mass-to-charge ratio of the window, the proportion of the quantities of the ions originating from the two kinds of compounds among the ions selected as the precursor ion changes with the change in the central mass-to-charge ratio. For example, if the quantity of the ions originating from the first compound among the ions selected as the precursor ion is relatively high, the peaks of the product ions generated by the dissociation of the ions originating from the first compound will have higher signal intensities on the $MS^n$ spectrum, while those of the product ions generated by the dissociation of the ions originating from the second compound will have lower signal intensities. Conversely, if the quantity of the ions originating from the second compound among the ions selected as the precursor ion is relatively high, the peaks of the product ions generated by the dissociation of the ions originating from the second compound will have higher signal intensities on the $MS^n$ spectrum, while those of the product ions generated by the dissociation of the ions originating from the first compound will have lower signal intensities.

Accordingly, based on the result of the comparison of the signal intensities of the product-ion peaks located at the same mass-to-charge ratio on a plurality of $MS^n$ spectra which respectively correspond to a plurality of windows having respectively different values of central mass-to-charge ratio, the product ion assignment determination processor ascertains, for each product ion, which of the plurality of ion species that are possibly present within the plurality of windows having respectively different values of central mass-to-charge ratio is the origin of that product ion, and determines the assignment of the same product ion. After the assignments of the product ions are determined, the spectrum reconstructor collects the information related to the product-ion peaks assigned to the same ion species to reconstruct the $MS^n$ spectrum. In this manner, a plurality of $MS^n$ spectra each of which shows only the product-ion peaks originating from one ion species are obtained from an $MS^n$ spectrum in which the product-ion peaks originating from a plurality of ion species are mixed. Needless to say, if there is only one compound to be identified, the $MS^n$ spectrum corresponding to the ion species of that compound only needs to be reconstructed.

On the other hand, in the mass spectrometer according to the second aspect of the present invention, the mass-to-charge-ratio range of the ion species to be dissociated is not changed in the phase of selecting the precursor ion to be dissociated but in the phase of dissociating the selected ion species. In the case where the ions are dissociated by collision-induced dissociation after the ions are temporarily held in the ion trap, the mass-to-charge-ratio range of the ion species to be dissociated is determined by the frequency of the radio-frequency voltage for resonant excitation applied to the ion trap. Accordingly, the measurement executer gradually changes the central frequency of the radio-frequency voltage for resonant excitation and performs an $MS^n$ analysis for the same sample for each change in the central frequency. Consequently, as in the first aspect of the present invention, a plurality of $MS^n$ spectra are obtained. By processing the data of these $MS^n$ spectra in the same manner as in the first aspect of the present invention, the assignment of each product ion which appears in those $MS^n$ spectra can be determined.

On an $MS^{n-1}$ spectrum obtained under a high level of mass-resolving power, if no peak of a different ion species is present near the target mass-to-charge ratio or near the ion species originating from the compound to be identified, i.e. if the target peak is an isolated peak, there is no possibility that the product-ion peaks originating from a plurality of kinds of ion species will be mixed in the $MS^n$ spectrum. Accordingly, it should be naturally understood that, in any of the mass spectrometers according to the first and second aspects of the present invention, the previously described characteristic measurement operation and the data processing for the thereby obtained data only need to be performed when a peak of a different ion species is present near the target mass-to-charge ratio or near the ion species originating from the compound to be identified on an $MS^{n-1}$ spectrum obtained under a high level of mass-resolving power.

Advantageous Effects of the Invention

With the mass spectrometer according to the present invention, even when there are a plurality of different ion species whose mass-to-charge ratios are extremely close to each other and it is difficult to separately dissociate each individual ion species, the assignment of each product ion to the plurality of ion species can be determined on an $MS^n$ spectrum in which the peaks of the product ions originating from those ion species are mixed. Therefore, an $MS^n$ spectrum which is more suitable for identifying the target compound, i.e. a high-purity $MS^n$ spectrum which includes no product ions originating from other ion species can be obtained. Consequently, for example, the accuracy of the compound identification by the database search is improved.

DESCRIPTION OF EMBODIMENTS

First Embodiment

An IT-TOFMS as the first embodiment of the mass spectrometer according to the present invention is hereinafter described with reference to the attached drawings.

Figure 1:
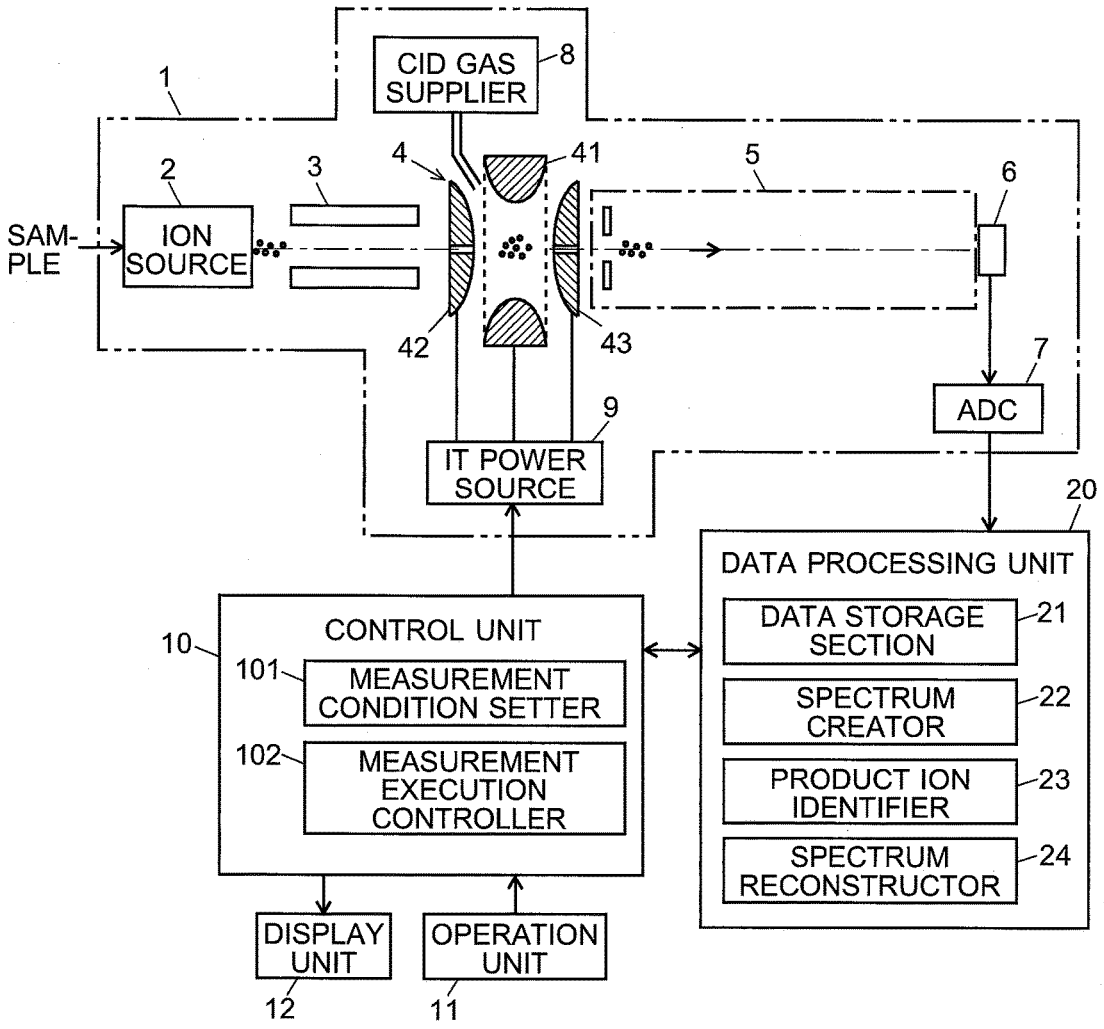
FIG. 1 is a configuration diagram showing the main components of an IT-TOFMS as the first embodiment of the present invention.

FIG. 1 is a configuration diagram showing the main components of the IT-TOFMS according to the first embodiment. Using FIG. 1, the configuration and operation of the IT-TOFMS of the present embodiment is hereinafter schematically described.

The IT-TOFMS of the present embodiment has a mass spectrometer unit 1, a control unit 10 with an operation unit 11 and a display unit 12 connected to it, as well as a data processing unit 20. The mass spectrometer unit 1 includes an ion source 2, an ion transport optical system 3 (e.g. an ion guide), an ion trap 4, a time-of-flight mass analyzer 5, an ion detector 6, an analogue-to-digital converter (ADC), a CID gas supplier 8, and an IT power source 9.

If the sample to be analyzed is a gas sample, the ion source 2 is an ion source which utilizes, for example, an electron ionization (EI) or chemical ionization (CI) method. If the sample to be analyzed is a liquid sample, the ion source 2 is an ion source which utilizes, for example, an electrospray ionization (ESI) or atmospheric chemical ionization (APCI) method. For some samples, an ion source utilizing other ionization methods may also be used, such as a laser desorption/ionization method in a broad sense (e.g. matrix-assisted laser desorption/ionization) or a real time direct ionization (direct analysis in real time; DART) method.

The ion trap 4 is a three-dimensional quadrupole ion trap including an annular ring electrode 41 as well as a pair of end cap electrodes 42 and 43 facing each other across the ring electrode 41. Alternatively, a linear ion trap may also be used. The time-of-flight mass analyzer 5 is a linear type, although a reflectron type or multi-turn type may also be used.

The IT power source 9, which includes a radio-frequency power source and a direct-current power source, applies predetermined voltages to the electrodes 41, 42 and 43 constituting the ion trap 4, respectively, under the command of the control unit 10. In the present embodiment, a rectangular voltage is used as the radio-frequency voltage. The CID gas supplier 8 continuously or intermittently supplies CID gas (which is an inert gas, such as helium or argon) to the ion trap 4 in the process of dissociating the ions within the ion trap 4.

The operation of a normal $MS^2$ analysis in the IT-TOFMS of the present embodiment is hereinafter schematically described.

In the ion source 2, various kinds of compounds in a sample are turned into various kinds of ions, which are introduced through the ion transport optical system 3 into the ion trap 4. The ions introduced into the ion trap 4 are captured due to the effect of the radio-frequency electric field created within the inner space of the ion trap 4 by the radio-frequency high voltage applied from the IT power source 9 to the ring electrode 41. Subsequently, a portion of the captured ions are ejected from the ion trap 4 by changing the duty ratio or frequency of the rectangular voltage applied from the IT power source 9 to the ring electrode 41. By this operation, only a kind of ion to be dissociated, i.e. the precursor ion to be analyzed is retained within the ion trap 4, while the other unnecessary ions are removed (precursor ion selection process).

Subsequently, with the CID gas being supplied to the ion trap 4, a radio-frequency voltage with a low amplitude is applied from the IT power source 9 to the end cap electrodes 42 and 43 to resonantly excite the captured ion. Consequently, the ion having an amount of kinetic energy collides with the CID gas, whereby the ion becomes dissociated, producing product ions (ion dissociation process). After the various product ions generated in this manner are temporarily captured in the ion trap 4, a predetermined level of direct-current voltage is applied from the IT power source 9 to the end cap electrodes 42 and 43. By this voltage application, the product ions are given a certain amount of acceleration energy and ejected from the ion trap 4, to be sent into the time-of-flight mass analyzer 5 (ion ejection process).

The speed of an ion flying in the flight space of the time-of-flight mass analyzer 5 depends on the mass-to-charge ratio of the ion. Therefore, each of the ions simultaneously ejected from the ion trap 4 reaches the ion detector 6 with a specific amount of flight time corresponding to its mass-to-charge ratio. The ion detector 6 produces a detection signal corresponding to the number of incident ions. The analogue-to-digital converter 7 converts the detection signal into digital data at predetermined intervals of sampling time.

The data processing unit 20 includes the following functional blocks: a data storage section 21 for storing a collection of data corresponding to the detection signals sequentially provided from the ion detector 6; a spectrum creator 22 for creating a mass spectrum (including an $MS^n$ spectrum) based on the data stored in the data storage section 21; a product ion identifier 23 for determining, for each product ion located on the mass spectrum, which ion species is the origin of the product ion; and a spectrum reconstructor 24 for once more creating a mass spectrum based on the result of the identification of the product ions. Normally, when signal intensities for product ions are obtained in an $MS^2$ analysis performed in the previously described manner, the spectrum creator 22 initially creates a time-of-flight spectrum showing the relationship between flight time and signal intensity, and subsequently converts the flight time into mass-to-charge ratio, based on previously determined mass calibration information, to create a mass spectrum showing the relationship between the mass-to-charge ratio and the signal intensity.

In the IT-TOFMS of the present embodiment, the control unit 10 and the data processing unit 20 can be configured using a personal computer as a hardware resource, with their respective functions realized by executing, on this personal computer, a dedicated controlling and processing software program previously installed on the same computer.

Figure 2:
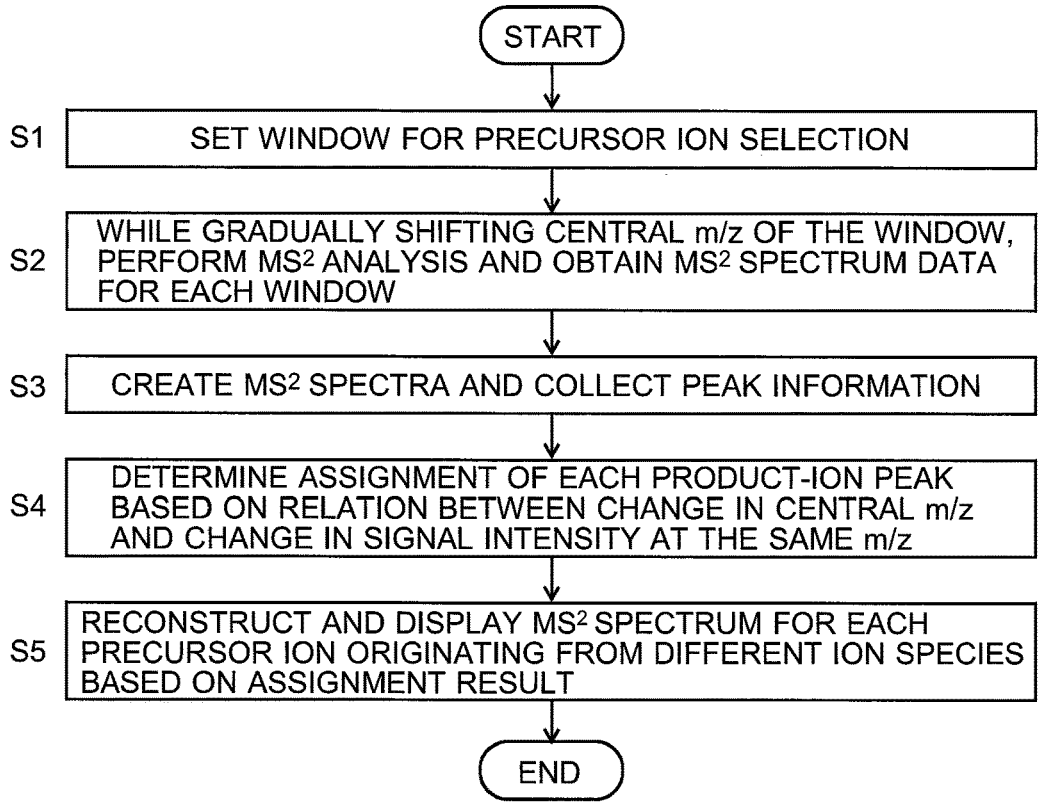
FIG. 2 is a flowchart showing the characteristic measurement operation and data-processing operation in the IT-TOFMS of the first embodiment.
Figure 3:
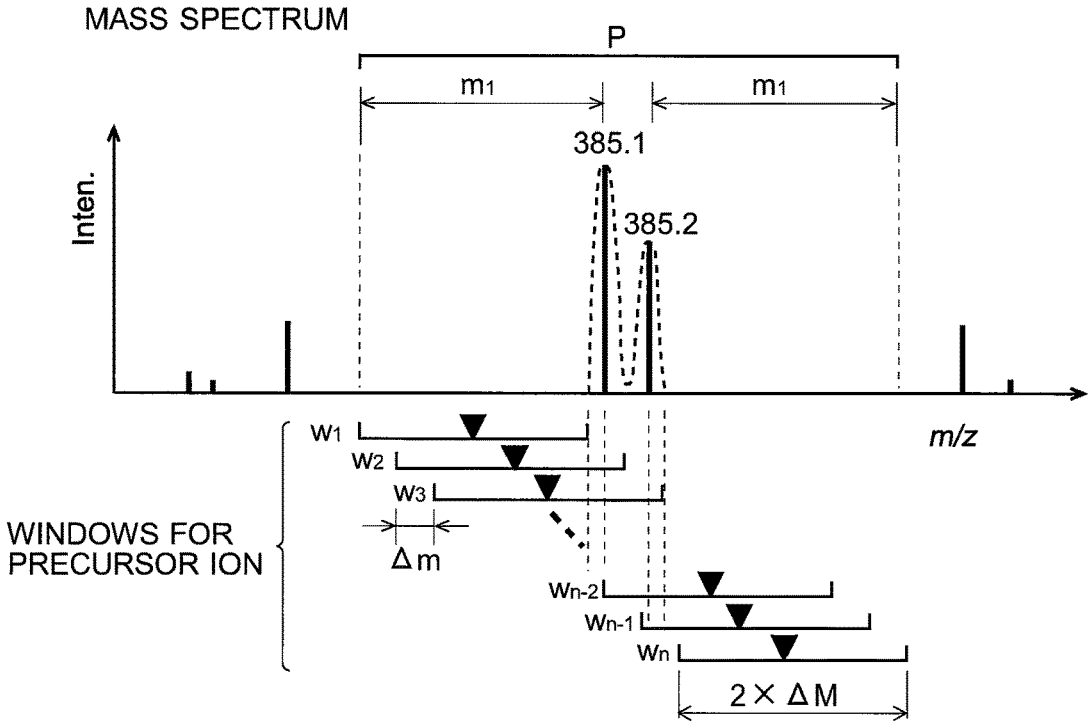
FIG. 3 is an explanatory diagram of the characteristic measurement operation in the IT-TOFMS of the first embodiment.

FIG. 2 is a flowchart showing the measurement operation and data-processing operation in the automatic product-ion separation measurement characteristic of the IT-TOFMS of the present embodiment. FIG. 3 is an explanatory diagram showing the measurement operation in the same automatic product-ion separation measurement.

Consider the case where a mass spectrum with two peaks observed around m/z 385 as shown in FIG. 3 has been obtained for a target sample as a result of a normal mass analysis ($MS^1$ analysis) which does not includes the operation of dissociating the ions in the ion trap 4. To identify the compounds corresponding to these peaks, a user (analysis operator) using the operation unit 11 specifies those peaks (or the mass-to-charge ratios corresponding to those peaks, i.e. m/z 385.1 and m/z 385.2) and commands the system to perform the automatic product-ion separation measurement.

Upon receiving this command, the measurement condition setter 101 in the control unit 10 initially sets the measurement mass-to-charge-ratio range based on the mass-to-charge ratios of the specified peaks, with a certain amount of margin on both the upper and lower sides of these mass-to-charge ratios. For example, the lower limit of the measurement mass-to-charge-ratio range P is set at $M_1-m_1$, where $M_1$ is the mass-to-charge ratio of the peak having the smallest mass-to-charge ratio among the specified peaks (in the example of FIG. 3, m/z 385.1) and $m_1$ is the predetermined margin, while the upper limit of the same range P is set at $M_2+m_1$, where $M_2$ is the mass-to-charge ratio of the peak having the largest mass-to-charge ratio among the specified peaks (in the example of FIG. 3, m/z 385.2) and $m_1$ is the predetermined margin, to eventually define the range from lower limit $M_1-m_1$ to upper limit $M_2+m_1$ as the measurement mass-to-charge-ratio range P. Furthermore, a plurality of windows having a predetermined mass-to-charge-ratio width for the precursor-ion selection (this window is hereinafter simply called the "window") are set from the lower limit to the upper limit of the measurement mass-to-charge-ratio range P, with every neighboring windows displaced from each other by a predetermined step width Δm (Step S1).

Specifically, in the example shown in FIG. 3, the window has a mass-to-charge-ratio width of ΔM on both the upper and lower sides of the central mass-to-charge ratio (which is indicated by the inverted triangle ▼ in FIG. 3). Accordingly, the central mass-to-charge ratio of the window having the smallest mass-to-charge ratio is set so that the lower end of the mass-to-charge-ratio width of this window coincides with the lower limit of the measurement mass-to-charge-ratio range P. In FIG. 3, this window is labeled $w_1$. Subsequently, the window is gradually shifted in the predetermined steps of Δm in the direction in which the mass-to-charge ratio increases. When the window has reached the position where the upper end of its mass-to-charge-ratio width coincides with the upper limit of the measurement mass-to-charge-ratio range P or a position where the upper limit of the measurement mass-to-charge-ratio range P falls within that mass-to-charge-ratio width, the window at that position is set as the window having the largest mass-to-charge ratio. In FIG. 3, this window is labeled $w_n$. In this manner, n windows from window $w_1$ to window $w_n$ are set so as to entirely cover the measurement mass-to-charge-ratio range P.

The margin $m_1$ for setting the measurement mass-to-charge-ratio range P, mass-to-charge-ratio width ΔM of the window, step Δm for gradually shifting the window, as well as other parameters may be previously specified as default values, or they may be appropriately entered or modified by the analysis operator. The previously described method of setting the measurement mass-to-charge-ratio range P and windows is a mere example and may be replaced by other appropriate setting methods.

After a plurality of windows have been set by the measurement condition setter 101 in the previously described manner, the measurement execution controller 102 controls the operations of the IT power source 9 and other sections of the mass spectrometer unit 1 so as to sequentially perform the $MS^2$ analysis using each of those windows as the condition of the precursor-ion selection. In other words, it repeatedly conducts the $MS^2$ analysis for the same target sample while gradually shifting the central mass-to-charge ratio of the mass-to-charge-ratio width for the precursor-ion selection (Step S2).

For example, in an $MS^2$ analysis using the window w1 in FIG. 3 as the condition of the precursor-ion selection, after the various ions generated from the target sample in the ion source 2 are captured in the ion trap 4, the IT power source 9 applies a radio-frequency rectangular voltage corresponding to the mass-to-charge-ratio range of the window w1 to the ring electrode 41, whereby only the ions which fall within the already described, the CID gas is introduced into the ion trap 4 and the captured ions are resonantly excited to promote the dissociation of the ions. The thereby generated product ions are mass-separated by the time-of-flight mass analyzer 5 and detected by the ion detector 6. Such an $MS^2$ analysis is performed for each window with a different mass-to-charge-ratio range, and a set of $MS^2$ spectrum data is collected for each window.

Through such a measurement, a plurality of sets of $MS^2$ spectrum data, with each set obtained using a different window, are stored in the data storage section 21 in the data processing unit 20. After the measurement is completed, the spectrum creator 22 reads the $MS^2$ spectrum data from the data storage section 21 and creates $MS^2$ spectra. Then, for each $MS^2$ spectrum, the spectrum creator 22 extracts each significant peak (e.g. a peak which has a signal intensity equal to or higher than a predetermined threshold) and collects the mass-to-charge ratio and signal intensity of that peak as the peak information (Step S3).

In the example of FIG. 3, two peaks which are likely to be formed by mutually different kinds of ion species are located close to each other (with a mass-to-charge-ratio difference of 0.1 Da) on the mass spectrum. The signal intensity of a peak reflects the number (amount) of ion species which have arrived at the ion detector 6. Therefore, as can be seen in FIG. 3, when the central mass-to-charge ratio of the window is shifted, the number of each ion species which fall within the window and are thereby selected as the precursor ion changes. The change in the proportion of the numbers of the two ion species selected as the precursor ion naturally causes a change in the signal intensity of the product ions originating from each ion species. For example, when the amount of ion species with m/z 385.1 is high and that of the ion species with m/z 385.2 is low, the signal intensities of the product ions originating from the ion species with m/z 385.1 will be relatively higher on the $MS^2$ spectrum. As the window is shifted in the direction in which the mass-to-charge ratio increases, the quantity of the ion species with m/z 385.2 selected as the precursor ion increases. Consequently, the signal intensities of the product ions originating from the ion species with m/z 385.1 decrease on the $MS^2$ spectrum, while those of the product ions originating from the ion species with m/z 385.2 increase.

Accordingly, based on the collected peak information, the product ion identifier 23 investigates the relation between the change in the central mass-to-charge ratio of the window and the change in the signal intensity of the product ion having the same mass-to-charge ratio, to ascertain, for each product ion, which of the plurality of ion species selected as the precursor ion is the origin of that product ion, and determine the assignment of the product ion (Step S4).

If there is a peak whose signal intensity barely changes with the change in the central mass-to-charge ratio of the window, that peak can be considered to be a noise peak which should not be assigned to any of the plurality of ion species.

Figure 4A:
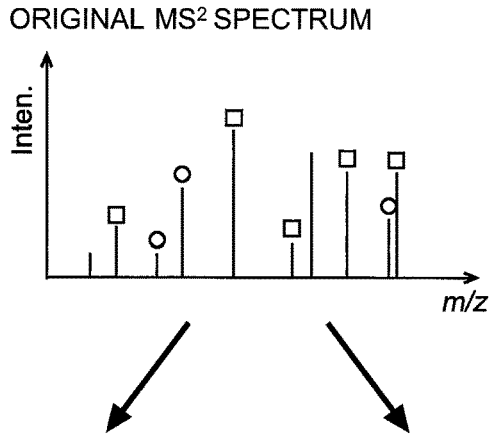
FIGS. 4A and 4B are explanatory diagrams of the characteristic data-processing operation in the IT-TOFMS of the first embodiment.
Figure 4B:
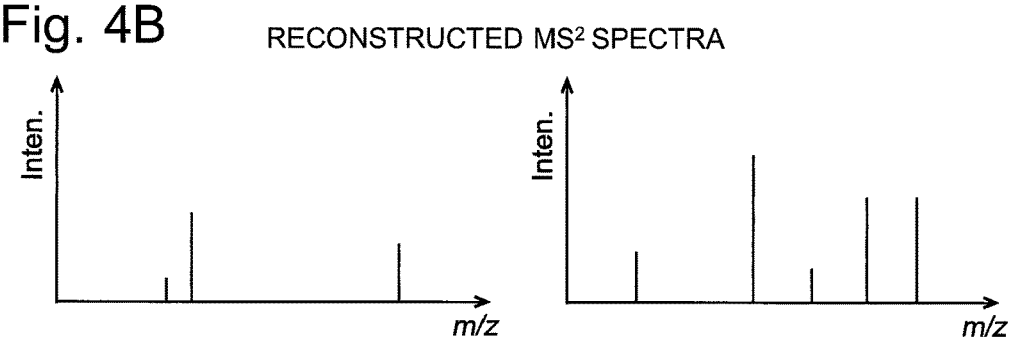

After the assignment has been determined for all product ions collected as the peak information (exclusive of the noise peaks), the spectrum reconstructor 24 sorts out the product-ion peaks according to the result of the assignment to reconstruct the $MS^2$ spectrum for each different ion species. Specifically, as shown in FIG. 4A, if the product ions assigned to the ion species with m/z 385.1 (indicated by the white circles ○ in FIG. 4A) and those assigned to the ion species with m/z 385.2 (indicated by the white squares □ in FIG. 4A) have been identified on the original $MS^2$ spectrum (the ion peaks with no symbol in FIG. 4A are not assigned to any ion species), an $MS^2$ spectrum with the ion species of m/z 385.1 as the precursor ion and an $MS^2$ spectrum with the ion species of m/z 385.2 as the precursor ion are created by the reconstruction process, as shown in FIG. 4B. The $MS^2$ spectra created by the reconstruction are displayed on the screen of the display unit 12 (Step S5).

Needless to say, in the case of identifying the compound by database search, de-novo sequencing or other techniques, the peak information based on the $MS^2$ spectra obtained by the reconstruction process in Step S5 can be used for the identification process. When only the $MS^2$ spectrum corresponding to one of the peaks located close to each other on the mass spectrum is necessary, only that spectrum needs to be created by the reconstruction.

In the previously described embodiment, the selection of the precursor ion and the dissociation of the ions are performed within the ion trap. However, it is evident that a tandem or $MS^n$ mass spectrometer having a different configuration may also be used, such as a triple quadrupole mass spectrometer in which the precursor ion is selected with a quadrupole mass filter while the dissociation of the ions is performed in a collision cell.

Second Embodiment

Next, an IT-TOFMS as the second embodiment of the mass spectrometer according to the present invention is described with reference to the attached drawings. The substantive configuration of the IT-TOFMS of the second embodiment is identical to that of the first embodiment. Accordingly, in the following description, FIG. 1 is used as the configuration diagram. The difference from the IT-TOFMS of the first embodiment is as follows: In the first embodiment, the mass-to-charge-ratio range of the ion species to be dissociated as the precursor ion is changed by shifting the precursor-ion selection window. By comparison, in the IT-TOFMS of the second embodiment, ion species with a certain wide range of mass-to-charge ratios are initially retained within the ion trap, and subsequently, the frequency range of the radio-frequency voltage for resonantly exciting the ions to cause CID ("excitation RF signal frequency range") is shifted to change the mass-to-charge-ratio range of the ion species to be actually dissociated.

Figure 5:
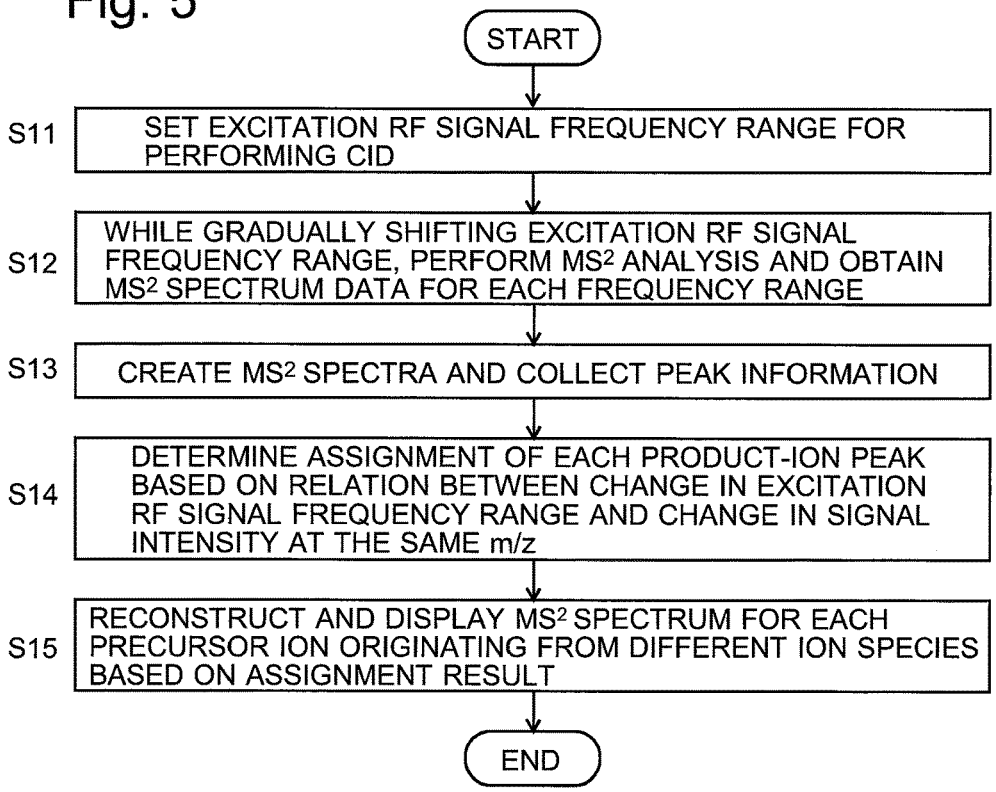
FIG. 5 is a flowchart showing the characteristic measurement operation and data-processing operation in the IT-TOFMS of the second embodiment.

FIG. 5 is a flowchart showing the measurement operation and data-processing operation in the automatic product-ion separation measurement characteristic of the IT-TOFMS of the second embodiment.

When an analysis operator using the operation unit 11 specifies a plurality of peaks or mass-to-charge ratios corresponding to those peaks and commands the system to perform the automatic product-ion separation measurement, the measurement condition setter 101 in the control unit 10 sets a plurality of excitation RF signal frequency ranges with different central frequencies in a similar manner to the setting of the windows in the first embodiment (Step S11).

Subsequently, the measurement execution controller 102 controls the operations of the IT power source 9 and other sections of the mass spectrometer unit 1 so as to sequentially perform an $MS^2$ analysis using each of the excitation RF signal frequency ranges as a condition of the dissociating operation. In other words, it repeatedly conducts the $MS^2$ analysis for the same target sample while gradually shifting the central frequency of the excitation RF signal frequency range within which the resonant excitation is induced to dissociate corresponding ions among various ions captured in the ion trap 4 (Step S12).

In this case, not all the ions remaining within the ion trap 4 after the precursor-ion selection are simultaneously dissociated; only the ions having mass-to-charge ratios within the mass-to-charge-ratio range corresponding to the frequency range of the radio-frequency voltage applied to the end cap electrodes 42 and 43 are resonantly excited and given a predetermined amount of energy to come in contact with the CID gas and become dissociated. The ions having other mass-to-charge ratios captured within the ion trap 4 remain intact, because they are insusceptible to the resonant excitation and will not become dissociated. In other words, while the former group of ions are dissociated into product ions, no product ions are generated from the latter group of ions. As a result, a set of $MS^2$ spectrum data similar to the one obtained with the IT-TOFMS of the first embodiment is obtained (although the peaks of the ions which had been selected as the precursor ion but were not dissociated remain within a high mass-to-charge-ratio range). Through such a process, a plurality of sets of $MS^2$ spectrum data, with each set obtained using a different excitation RF signal frequency range, are stored in the data storage section 21 in the data processing unit 20.

After the measurement is completed, the spectrum creator 22 reads the $MS^2$ spectrum data from the data storage section 21 and creates $MS^2$ spectra. Then, for each $MS^2$ spectrum, the spectrum creator 22 extracts significant peaks observed on the spectrum and collects the mass-to-charge ratios and signal intensities of those peaks as the peak information (Step S13). It should be noted that the $MS^2$ spectra obtained in this step may possibly include peaks of the ions which were retained within the ion trap 4 through the precursor-ion selection process but were not dissociated. However, such peaks should also be present in the original mass spectrum. Therefore, it is possible to remove such peaks other than the product ions by excluding, from the peak information of the $MS^2$ spectra, any peak whose mass-to-charge ratio has also been observed in the original mass spectrum.

Similarly to the first embodiment in which the window is gradually shifted in the direction in which the mass-to-charge ratio increases, when the mass-to-charge-ratio range in which the resonant excitation is induced is gradually shifted in the direction in which the mass-to-charge ratio increases, the signal intensities of the product ions originating from a plurality of different ion species change. Accordingly, based on the collected peak information, the product ion identifier 23 investigates the relation between the change in the central frequency of the excitation RF signal frequency range and the change in the signal intensity of the product ion having the same mass-to-charge ratio, to ascertain, for each product ion, which of the plurality of ion species selected as the precursor ion is the origin of that product ion, and determine the assignment of the product ion (Step S14).

After the assignment has been determined for all product ions collected as the peak information, the spectrum reconstructor 24 reconstructs the $MS^2$ spectrum for each different ion species through the same process as Step S5, and displays the $MS^2$ spectra on the screen of the display unit 12 (Step S15).

In the previously described manner, the IT-TOFMS of the second embodiment can separate product ions originating from a plurality of ion species located close to each other on the mass spectrum and create an $MS^2$ spectrum for each ion species, similarly to the IT-TOFMS of the first embodiment.

While the first embodiment may be a mass spectrometer in which ions are dissociated in a collision cell, the second embodiment cannot be applied in such a mass spectrometer. The reason for this is because, in such a mass spectrometer, the ions selected as the precursor ion are entirely dissociated and it is impossible to arbitrarily set the mass-to-charge-ratio range of the ions to be dissociated in addition to the mass-to-charge ratio for the selection of the precursor ion. Accordingly, the second embodiment is limited to such a mass spectrometer that includes an ion-holding section (e.g. a three-dimensional quadrupole ion trap or linear ion trap) and thereby allows an arbitrary setting of the mass-to-charge-ratio range of the ions to be dissociated in addition to the mass-to-charge ratio for the selection of the precursor ion.

It should be noted that any of the previous embodiments is a mere example of the present invention, and any change, modification or addition appropriately made within the spirit of the present invention will evidently fall within the scope of claims of the present application. For example, as opposed to the previous embodiments in which the automatic product-ion separation measurement is performed in the process of obtaining $MS^2$ spectra, the automatic product-ion separation measurement may be similarly performed to obtain $MS^n$ spectra with n being equal to or greater than three.

REFERENCE SIGNS LIST

1 . . . Mass Spectrometer Unit
2 . . . Ion Source
3 . . . Ion Transport Optical System
4 . . . Ion Trap
41 . . . Ring Electrode
42, 43 . . . End Cap Electrode
5 . . . Time-of-Flight Mass Analyzer
6 . . . Ion Detector
7 . . . Analogue-to-Digital Converter
8 . . . CID Gas Supplier
9 . . . IT Power Source
10 . . . Control Unit
101 . . . Measurement Condition Setter
102 . . . Measurement Execution Controller
11 . . . Operation Unit
12 . . . Display Unit
20 . . . Data Processing Unit
21 . . . Data Storage Section
22 . . . Spectrum Creator
23 . . . Product Ion Identifier
24 . . . Spectrum Reconstructor

The invention claimed is:

1. A mass spectrometer for performing an $MS^n$ analysis, where n is any integer equal to or greater than two, by selecting an ion through a window having a predetermined mass-to-charge-ratio width from among ions originating from a sample, dissociating the selected ion as a precursor ion, and performing a mass spectrometry for product ions generated by the dissociation, the mass spectrometer comprising:

a) a measurement executer for:

changing a central mass-to-charge ratio of the window;

performing an $MS^n$ analysis for a same sample for each of the changed central mass-to-charge ratio;

obtaining a plurality of $MS^n$ spectra corresponding to a plurality of windows of the changed central mass-to-charge ratio, respectively; and extracting a signal intensity of product-ion peaks appearing at a same mass-to-charge ratio on the plurality of $MS^n$ spectra;

b) a product ion assignment determination processor for;

comparing a change in the central mass-to-charge ratio of the plurality of windows and a change in the signal intensity of the product-ion peaks appearing at the same mass-to-charge ratio; and determining, based on a result of the comparison, an assignment of each product ion by ascertaining which of a plurality of ion species that are possibly present within the plurality of windows having respectively different values of central mass-to-charge ratio is an origin of that product ion; and c) a spectrum reconstructor for reconstructing the $MS^n$ spectrum for one ion species based on a result of the assignment of the product ions by the product ion assignment determination processor.

2. A mass spectrometer for performing an $MS^n$ analysis, where n is any integer equal to or greater than two, by selecting an ion included within a predetermined mass-to-charge-ratio width from among ions originating from a sample, dissociating the selected ion as a precursor ion, and performing a mass spectrometry for product ions generated by the dissociation, the dissociation of the ion performed by temporarily capturing an ion to be dissociated in an ion trap and then inducing resonant excitation of the captured ion by an effect of a radio-frequency electric field to make the ion collide with gas, the mass spectrometer comprising:

a) a measurement executer for:

changing a central frequency of a radio-frequency voltage applied to the ion trap for the resonant excitation;

performing an $MS^n$ analysis for a same sample for each change in the central frequency;

obtaining a plurality of $MS^n$ spectra corresponding to a plurality of windows of the changed central frequency, respectively; and extracting a signal intensity of product-ion peaks appearing at a same mass-to-charge ratio on the plurality of $MS^n$ spectra;

b) a product ion assignment determination processor for:

comparing a change in the central frequency of the window and a change in the signal intensity of the product-ion peaks appearing at the same mass-to-charge ratio; and determining, based on a result of the comparison, an assignment of each product ion by ascertaining which of a plurality of ion species that are possibly present within the predetermined mass-to-charge-ratio width is an origin of that product ion; and c) a spectrum reconstructor for reconstructing the $MS^n$ spectrum for one ion species based on a result of the assignment of the product ions by the product ion assignment determination processor.

* * * * *